US008510892B1

(12) United States Patent
Sampaio

(10) Patent No.: US 8,510,892 B1
(45) Date of Patent: Aug. 20, 2013

(54) RACK AND PINION ROLLER MOP

(71) Applicant: Casabella Holdings, LLC, Congers, NY (US)

(72) Inventor: Andre Sampaio, Valley Cottage, NY (US)

(73) Assignee: Casabella Holdings, LLC, Congers, NY (US)

( * ) Notice: Subject to any disclaimer, the term of this patent is extended or adjusted under 35 U.S.C. 154(b) by 0 days.

(21) Appl. No.: 13/691,073

(22) Filed: Nov. 30, 2012

(51) Int. Cl.
*A47L 13/144* (2006.01)

(52) U.S. Cl.
USPC ..... 15/119.2

(58) Field of Classification Search
USPC ..... 15/116.1, 116.2, 119.1, 119.2
See application file for complete search history.

(56) References Cited

U.S. PATENT DOCUMENTS

| | | | | |
|---|---|---|---|---|
| 419,387 | A * | 1/1890 | Westbrook | 15/119.1 |
| 1,492,839 | A * | 5/1924 | Dusevoir et al. | 15/119.1 |
| 1,577,180 | A * | 3/1926 | Craib | 15/119.1 |
| 1,912,543 | A * | 6/1933 | Sendler | 15/119.2 |
| 2,201,079 | A * | 5/1940 | Camden | 15/119.2 |
| 2,596,026 | A | 10/1949 | Howells | |
| 2,655,681 | A | 10/1953 | Swanson | |
| 3,226,752 | A | 1/1966 | Antonucci | |
| 3,916,470 | A | 11/1975 | May | |
| 4,961,374 | A | 10/1990 | Lee | |
| 5,701,630 | A | 12/1997 | Liao | |
| 5,979,004 | A | 11/1999 | Wilson | |
| 6,000,087 | A | 12/1999 | Petner | |
| 6,212,728 | B1 | 4/2001 | Facca | |
| 8,046,863 | B2 | 11/2011 | Berti et al. | |
| 2003/0208867 | A1 | 11/2003 | Laux | |
| 2005/0198838 | A1 | 9/2005 | Brucart Bonich | |
| 2007/0209130 | A1 | 9/2007 | Cann | |
| 2008/0178405 | A1 | 7/2008 | Berti | |
| 2010/0229736 | A1 | 9/2010 | Griffith | |

FOREIGN PATENT DOCUMENTS

| | | | |
|---|---|---|---|
| DE | 3201893 | A1 | 1/1982 |

* cited by examiner

*Primary Examiner* — Mark Spisich
(74) *Attorney, Agent, or Firm* — Curtis, Mallet-Prevost, Colt & Mosle LLP

(57) ABSTRACT

A rack and pinion roller mop is disclosed that has a mop head with a sponge receiver opening and a pole receiver where rollers are rotationally engaged with the mop head and a sponge head is affixed to a pole where the pole moves the sponge head between the rollers with a rack and pinion arrangement driven by a lever attached to the pinion. The rack has a hollow rack cylinder that the pole is placed through and the sponge head has a sponge head support with a coupler having a retention tab receiver to engage a retention tab on the rack cylinder.

21 Claims, 9 Drawing Sheets

RACK AND PINION ROLLER MOP

BACKGROUND OF THE INVENTION

1. Field of the Invention

This invention relates generally to cleaning devices, and more specifically to a rack and pinion roller mop.

2. Description of Related Art

Wet mops have been used for many years to clean hard surface floors and related surfaces. While the liquid used with the mop may simply be water, oftentimes cleaning solutions are added to the water to facilitate the cleaning process. As the wet mop is pushed across a hard surface floor, dirt and other undesirable materials are loosened and retained in the wet mop material. Such material may be a sponge, strands of fiber, cloth, or the like. Once the wet mop material becomes full of such undesirables, a bucket of water, perhaps also containing cleaning solution, is typically used to rinse the wet mop material. During and after rinsing, it is desirable to wring out the wet mop material to remove dirt and liquid. There are several ways in which the wet mop may be wringed out. The wet mop material may be placed between two or more rollers that are in close proximity to each other and moved through these rollers in such a way that dirt and liquid are expelled. The entire mop head containing the wet mop material may also be folded or otherwise compressed together to remove dirt and liquid. These actions, while adequate for removing water and dirt from the mop head material, often require a fair amount of physical strength and dexterity. This makes many wet mops inconvenient for the elderly, those with limited physical strength or dexterity, those with physical disabilities, and the like.

What is needed is a wet mop with a mechanism that is easy to use.

It is thus an object of the present invention to provide a wet mop with a rack and pinion arrangement for easily moving the wet mop material between rollers. It is another object of the present invention to provide a wet mop with a rack and pinion arrangement that has a novel sponge head retention arrangement. It is another object of the present invention to provide a wet mop with a rack and pinion arrangement that has a novel pole and rack arrangement.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a rack and pinion roller mop comprising a mop head comprising a sponge receiver opening and a pole receiver; a first roller and a second roller rotationally engaged with the mop head; a sponge head support coupled to a sponge head where the sponge head support is generally located between the first roller and the second roller; an Italian thread coupler comprising a retention tab receiver fixedly attached to the sponge head support; a rack cylinder having a plurality of teeth along an outer surface of the rack cylinder; a retention tab mechanically coupled to the rack cylinder for mating with the retention tab receiver of the Italian thread coupler; a pole having an Italian thread end and placed through the rack cylinder and mated with the Italian thread coupler; a pinion lever having a pin receiver and a pinion gear arrangement where in operation the pinion gear engages with the rack cylinder so that when the pinion lever is moved there is linear movement of the rack cylinder, sponge head support and sponge head thereby compressing the sponge head between the first roller and the second roller.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
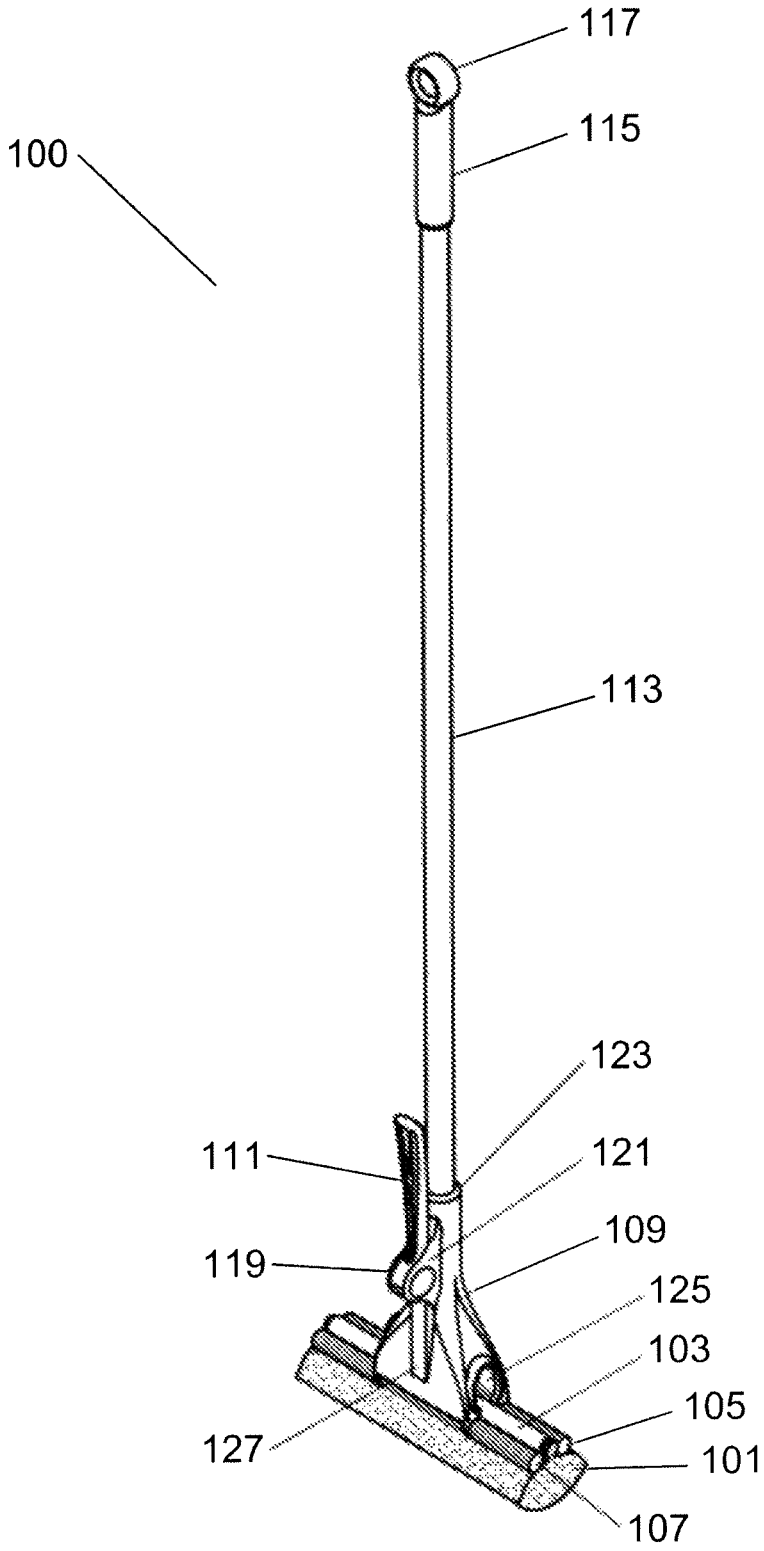
FIG. 1 is a perspective view of a rack and pinion roller mop.

The attached figures depict various views of the rack and pinion roller mop in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Rack And Pinion Roller Mop is described and depicted by way of this specification and the attached drawings.

For a general understanding of the present invention, reference is made to the drawings. In the drawings, like reference numerals have been used throughout to designate identical elements.

Figure 2:
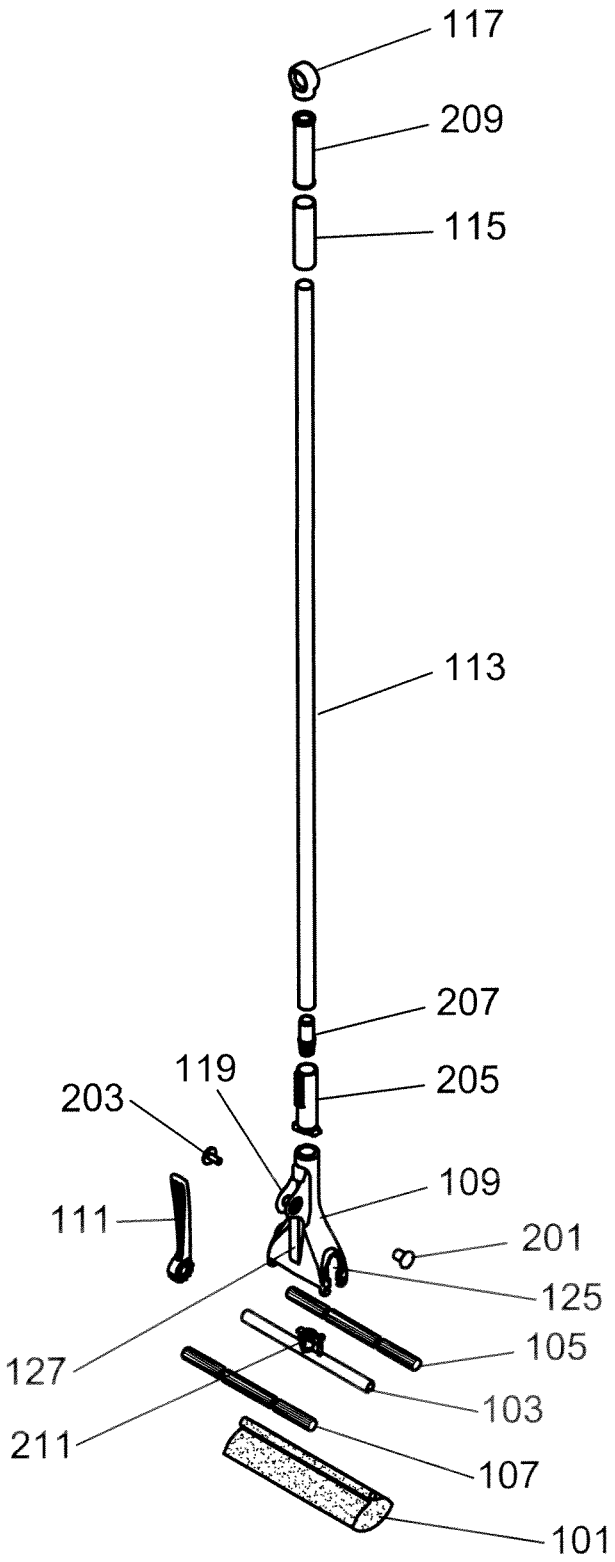
FIG. 2 is an exploded view of the rack and pinion roller mop.
Figure 15:
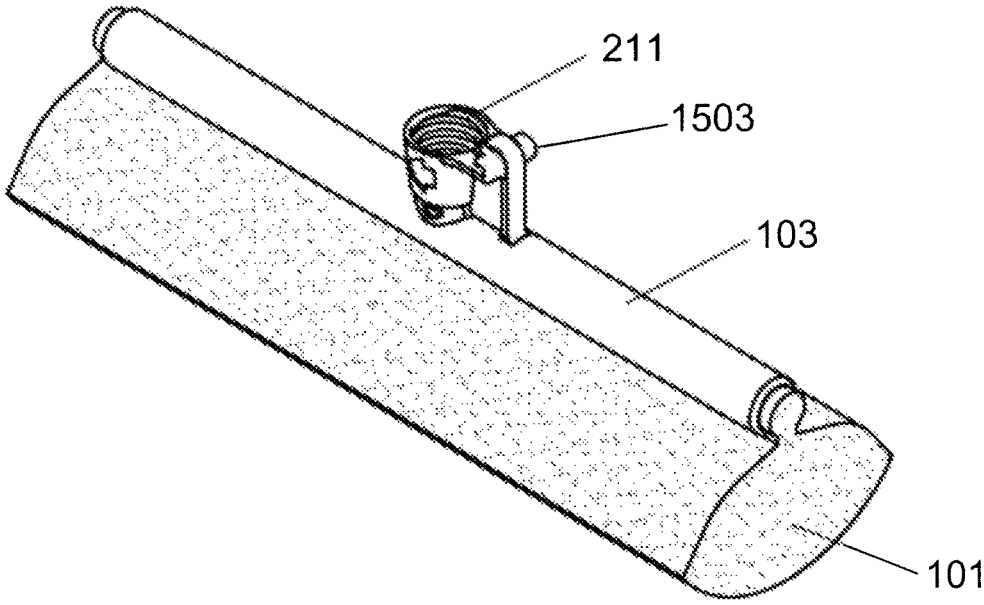
FIG. 15 is a perspective view of the sponge head, sponge head support and Italian thread coupler of the rack and pinion roller mop.

Referring to FIG. 1, a perspective view of the Rack And Pinion Roller Mop 100 is shown. For clarity, an exploded view of the Rack and Pinion Roller Mop 100 is depicted in FIG. 2 and is referred to in conjunction with the description for FIG. 1. The remaining figures provide various views of the Rack and Pinion Roller Mop 100 and also detailed views of some of the components thereof. The Rack and Pinion Roller Mop 100 is depicted with the pinion lever 111 in the upright position, indicating that the sponge head 101 is in front of, and not compressed by, the rollers 105 and 107. This represents a typical ready to mop position. If the pinion lever 111 was moved downward, it would operate the rack and pinion arrangement and draw the sponge head 101 upward and between the rollers 105 and 107, thus compressing or wringing the sponge head 101. The sponge head 101 may be a synthetic sponge such as a polyurethane sponge, a cellulose sponge, a polyester sponge, a polyvinyl alcohol (PVA) sponge, a low density polyether sponge, or the like. In some embodiments of the present invention, additional materials such as a scouring pad may be attached to the sponge head 101 to facilitate cleaning. The rack and pinion roller mop 100 has a mop head 109 that retains many of the components of the rack and pinion roller mop 100. The mop head 109 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The mop head 109 may be made by injection molding, blow molding, machining, or the like. The mop head 109 has a sponge receiver opening 125 that not only accommodates the sponge head 101 when being compressed by the rollers 105 and 107, but also may have, in some embodiments of the present invention, an enlarged opening on either one or both sides of the mop head 109 to facilitate ease of removal and replacement of the sponge head 101. The sponge receiver opening 125 may be u-shaped, and may, in some embodiments of the present invention, have a rectangular or square opening overlaid on the u-shaped opening on either one or both ends of the mop head 109. The mop head also has a pole receiver 123 that is of a diameter slightly larger than the diameter of the pole 113 to allow the pole 113 to move freely through the mop head 109 when the pinion lever 111 is moved so that in turn the sponge head 101 is compressed through the rollers 105 and 107. A first roller 105 and a second roller 107 are rotationally engaged with the mop head 109 as further depicted in FIG. 1. The rollers may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The rollers may be made by injection molding, blow molding, machining, or the like. A sponge head support 103 can be seen coupled to the sponge head 101 where the sponge head support 103 is generally located between the first roller 105 and the second roller 107. The sponge head support 103 may be of a length similar to the length of the sponge head 101, and may have an opening therein to receive the sponge head 101. In one embodiment of the present invention the sponge head support 103 may be of a tubular shape with a lengthwise opening to accommodate the sponge head 101. The tubular shape may be cylindrical, square, rectangular, or the like. Mechanical compression, an adhesive, mechanical fasteners, or the like, may be used to retain the sponge head 101 to the sponge head support 103. The sponge head support 103 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The sponge head support 103 may be made by injection molding, blow molding, machining, or the like. An Italian thread coupler 211 comprising a retention tab receiver 1503 as seen in FIG. 15 is fixedly attached to the sponge head support 103. The Italian thread coupler 211 and related retention tab receiver 1503 cannot be seen in FIG. 1, but can be seen in FIG. 2 and are shown and described in detail in FIG. 15. The sponge head support 103 as well as the Italian thread coupler 211 and related retention tab receiver 1503 (see FIG. 15) may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The sponge head support 103 and the Italian thread coupler and related retention tab receiver may be made by injection molding, blow molding, machining, or the like. A rack cylinder 205 can be seen in the exploded view of FIG. 2. The rack cylinder 205 has a plurality of teeth along an outer surface of the rack cylinder 205 for engaging with the pinion of the pinion lever 111. The plurality of teeth may traverse a partial or a complete length of the rack cylinder 205 and may span only a part of the circumference of the rack cylinder 205, or may, in some embodiments of the present invention, span the complete circumference of the rack cylinder 205. The rack cylinder 205 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The rack cylinder 205 may be made by injection molding, blow molding, machining, or the like. Further, and as can be seen in FIG. 2 and with greater clarity in FIG. 8, retention tab 803 (as seen clearly in FIG. 2) is mechanically coupled to the rack cylinder 205 for mating with the retention tab receiver 1503 of the Italian thread coupler 211. A pole 113 having an Italian thread end 207 is placed through the rack cylinder 205 and mated with the Italian thread coupler 211. To retain the rack cylinder to the pole 113, inner threads may be used within the rack cylinder 205 that engage with the Italian thread end 207 of the pole 113. Other fastening techniques may also be employed, such as screws, pins, slotted fasteners, and the like. The pole 113 may be made from a metal such as steel, or from a plastic or a reinforced plastic, fiberglass, wood, or the like. The Italian thread end 207 may also be made from a plastic, a metal, or wood. The term "Italian thread" refers to a standard thread used for cleaning items such as mops, brooms, dusters, and the like; however, any threaded or fastening arrangement may be suitable for this purpose, and is considered to be within the scope and content of the present invention. The pole 113 may also have an annular end 117 that comprises an annular or ring-like form that is retained to the pole 113, and may, in some embodiments of the present invention, swivel or move with respect to the pole 113. The annular end 117 allows a user to hang the mop for storage, and also provides a comfortable end to grip, as evident by the coupler overlay 115 that is made of a soft durometer material to provide a comfortable and slip resistant grip. As can be seen in FIG. 2, the annular end 117 is attached to the pole 113 by way of a coupler 209. This coupler allows the annular end 117 to swivel by way of a rotational joint 703 that is attached to the annular end 117 and can be clearly seen in FIG. 7. The coupler 209 and the annular end 117 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The coupler 209 and the annular end 117 may be made by injection molding, blow molding, machining, or the like. To cause the rack cylinder 205 and the attached pole 113 to move in a linear manner such that the attached sponge head 101 moves between the first roller 105 and the second roller 107, a pinion lever 111 having a pin receiver 903 (see FIG. 9) and a pinion gear 901 (again, see FIG. 9) is retained by a first pinion lever receiver 119 and a second pinion lever receiver 121 with a pin arrangement such as a coupled first pin 201 and second pin 203 where in operation the pinion gear 901 engages with the rack cylinder 205 so that when the pinion lever 111 is moved there is linear movement of the rack cylinder 205 that is in turn attached to the pole 113, and the attached sponge head support 103 and sponge head 101 moves so that the sponge head 101 is compressed between the first roller 105 and the second roller 107. The first pin 201 and the second pin 203 go through the pin receiver 903 (see FIG. 9) that is a void or hole in the pinion gear 901 (see FIG. 9) so that the pin receiver 903 moves around the first pin 201 and the second pin 203 when the pinion lever 111 is moved. The first pin 201 and the second pin 203 are connected together using any of the push in fastening techniques known to those skilled in the art. When configured this way, the first pin 201 and the second pin 203 do not move when the pinion lever 111 is moved, although they are free to do so if the pin receiver 903 were coupled to either the first pin 201 or the second pin 203. The first pin 201 and the second pin 203 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The first pin 201 and the second pin 203 may be made by injection molding, blow molding, machining, or the like. The pinion lever receivers are attached to or molded or formed with the mop head 109. Between the first pinion lever receiver 119 and the second pinion lever receiver 121 there is a space, void or opening in the mop head 109 to allow the pinion gear 901 (see FIG. 9) that is attached to the pinion lever 111 to engage with the rack cylinder 205. The first pinion lever receiver 119 and the second pinion lever receiver 121 are, in one embodiment of the present invention, of a generally arced or curvilinear shape. Other geometries being considered alternative embodiments of the present invention. In addition, in some embodiments of the present invention, a support 127 is connected to the pinion lever receivers to provide structural integrity and strength to the mop head while force is being applied to the pinion lever 111. The support 127 may be made from the same material as the mop head 109 and may, in some embodiments of the present invention, be molded or formed with the mop head 109.

Figure 3:
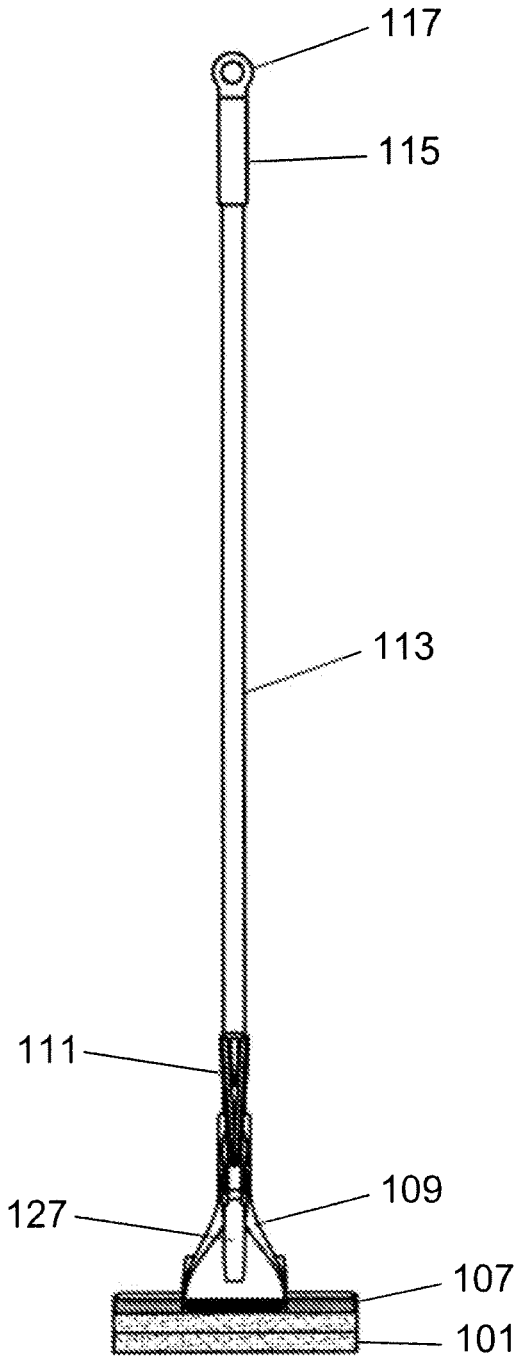
FIG. 3 is a front plan view of the rack and pinion roller mop.
Figure 4:
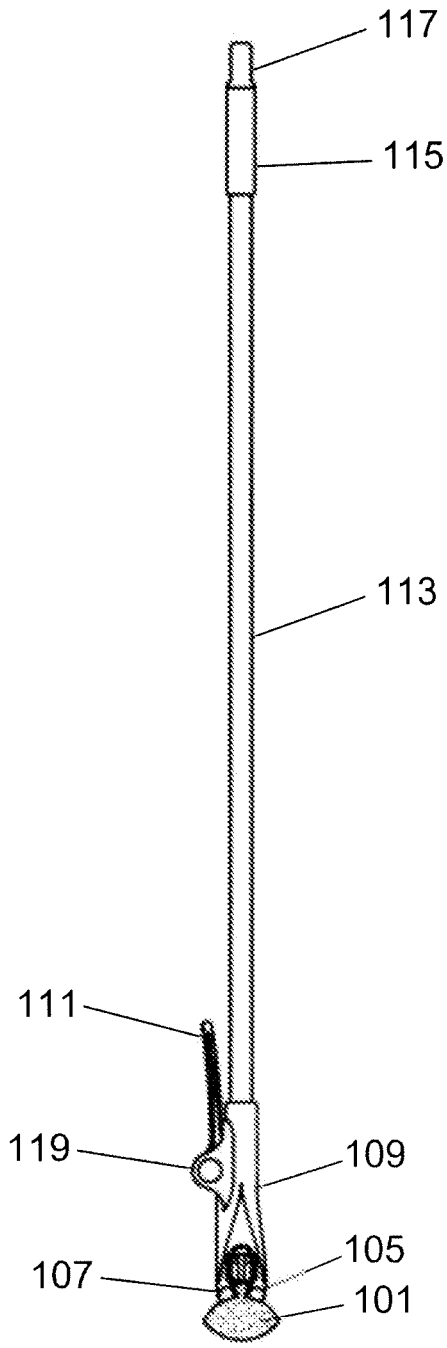
FIG. 4 is a side plan view of the rack and pinion roller mop.
Figure 5:
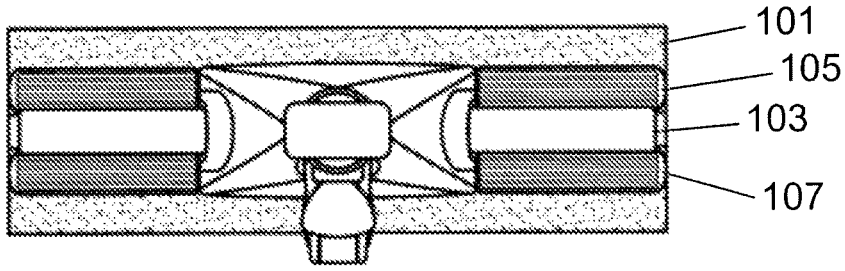
FIG. 5 is a top plan view of the rack and pinion roller mop.
Figure 6:
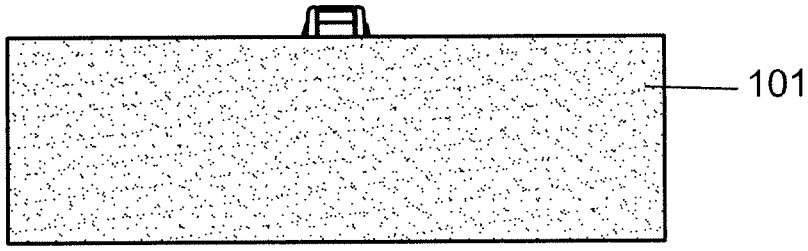
FIG. 6 is a bottom plan view of the rack and pinion roller mop.

FIGS. 3-6 represent various views of the Rack and Pinion Roller Mop. FIG. 3 is a front plan view of the rack and pinion roller mop, FIG. 4 is a side plan view of the rack and pinion roller mop, FIG. 5 is a top plan view of the rack and pinion roller mop, and FIG. 6 is a bottom plan view of the rack and pinion roller mop.

Figure 7:
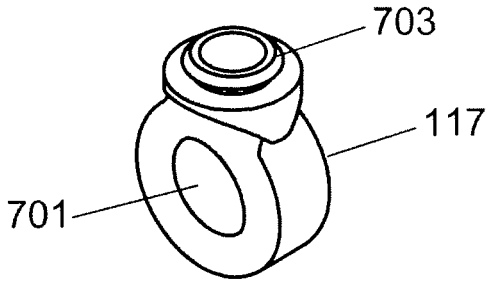
FIG. 7 is a perspective view of the annular end of the rack and pinion roller mop.

Turning now to FIG. 7, a perspective view of the annular end 117 of the rack and pinion roller mop is depicted removed from the pole and related coupler. An opening 701 can be seen such that an annular or ring-like shape is formed. A rotational joint 703 can be seen that comprises a flared out circumferential structure that engages with the coupler which in turn is connected to the pole. This flared out circumferential structure may have a tapered or angled surface to facilitate placement of the rotational joint 703 in the coupler. The annular end 117 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The annular end 117 may be made by injection molding, blow molding, machining, or the like.

Figure 8:
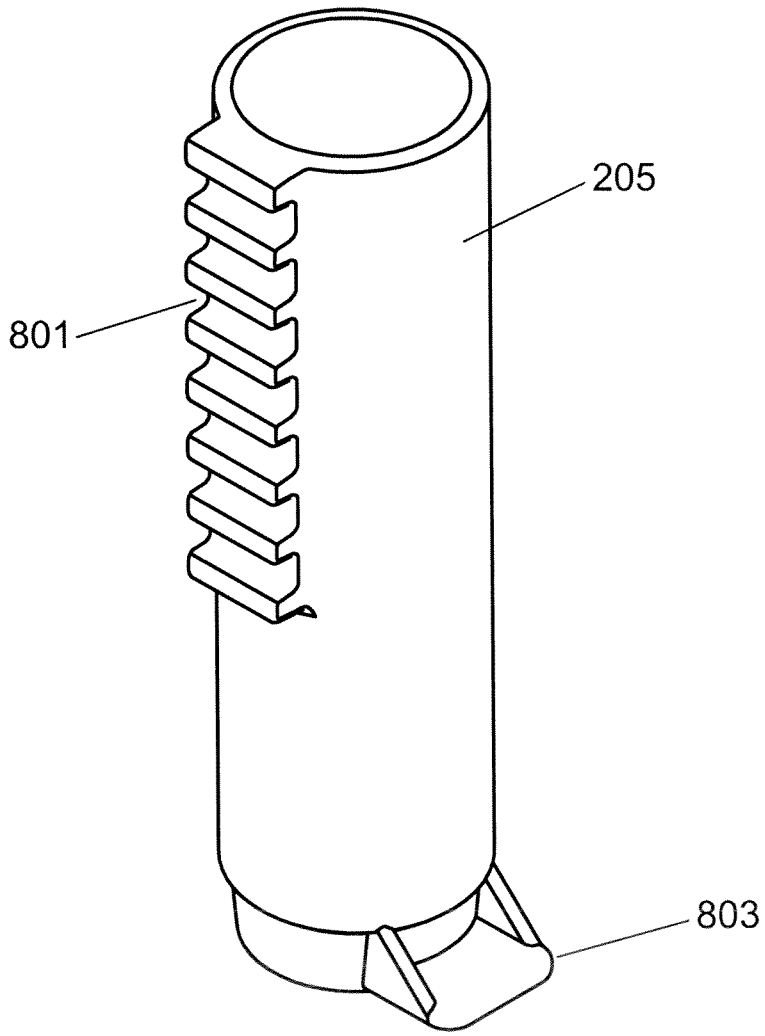
FIG. 8 is a perspective view of the rack cylinder of the rack and pinion roller mop.

FIG. 8 is a perspective view of the rack cylinder 205 of the rack and pinion roller mop. The rack cylinder 205 has a plurality of teeth forming a rack 801 along an outer surface of the rack cylinder 205. The plurality of teeth may traverse a partial or a complete length of the rack cylinder 205 and may span only a part of the circumference of the rack cylinder 205, or may, in some embodiments of the present invention, span the complete circumference of the rack cylinder 205. The rack cylinder 205 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The rack cylinder 205 may be made by injection molding, blow molding, machining, or the like. To facilitate replacement of the sponge head, a retention tab 803 is mechanically coupled to the rack cylinder 205 for mating with the retention tab receiver 1503 of the Italian thread coupler 211, as depicted in FIGS. 15 and 2 respectively. The retention tab 803 projects outwardly from the rack cylinder and may be generally rectangular or square in some embodiments of the present invention. Gussets, supports, or similar structures may be employed that further connect the retention tab 803 to the rack cylinder 205 and provide for improved structural integrity. To retain the rack cylinder 205 to the pole 113 of FIG. 1, inner threads may be used within the rack cylinder 205 that engage with the Italian thread end 207 of the pole 113. These inner threads being of a style similar to the thread used for the Italian thread end 207 and the Italian thread end coupler 211, both depicted in FIG. 2. Other fastening techniques may also be employed, such as screws, pins, slotted fasteners, and the like. The pole 113 may be made from a metal such as steel, or from a plastic or a reinforced plastic, fiberglass, wood, or the like. The Italian thread end 207 may also be made from a plastic, a metal, or wood.

Figure 9:
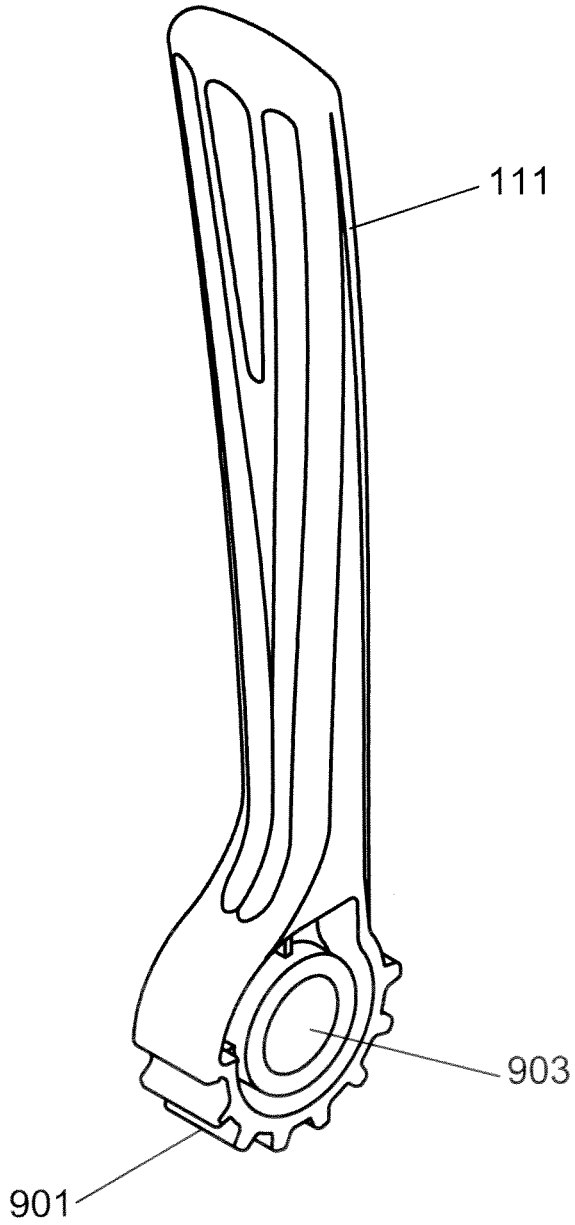
FIG. 9 is a perspective view of the pinion lever of the rack and pinion roller mop.

FIG. 9 is a perspective view of the pinion lever of the rack and pinion roller mop. The pinion lever 111 has a pinion gear 901 attached to one end of the pinion lever. The pinion gear 901 has a pin receiver 903 that is an opening such as a circular hole that accommodates pins or similar retention structures that serve to hold the pinion lever to the mop head while still allowing for rotational movement of the pinion lever 111 and attached pinion gear 901.

Figure 10:
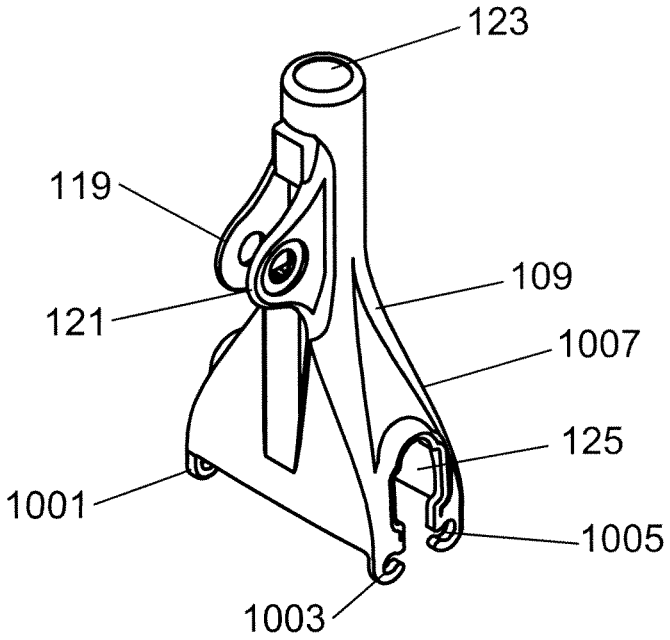
FIG. 10 is a perspective view of the mop head of the rack and pinion roller mop.

FIG. 10 is a perspective view of the mop head of the rack and pinion roller mop with the sponge head and rollers removed or clarity. Roller retainers are attached to or otherwise molded with the mop head 109 and may, in some embodiments of the present invention, be shaped as hooks. A first roller 105, as seen in FIG. 1, has a first retainer shaft 1201 and a second retainer shaft 1203 (see FIG. 12). The first retainer shaft 1201 of the first roller 105 being retained by the first roller retainer 1001 and the second retainer shaft 1203 (see FIG. 12) of the first roller 105 being retained by the second roller retainer 1003. A second roller 107, as seen in FIG. 1, also has a first retainer shaft 1201 and a second retainer shaft 1203 (see FIG. 12). The first retainer shaft 1201 of the second roller 107 being retained by the third roller retainer 1005 and the second retainer shaft 1203 (see FIG. 12) of the second roller 107 being retained by the fourth roller retainer 1007. The roller retainers being of a size to securely retain the retainer shafts of the rollers, but also being sufficiently large with respect to the retainer shafts so that the retainer shafts spin freely in the roller retainers without binding or otherwise creating frictional resistance.

Figure 11:
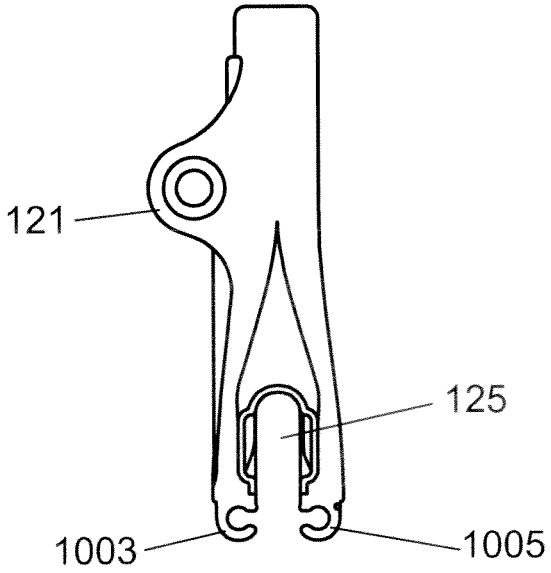
FIG. 11 is a side plan view of the mop head of the rack and pinion roller mop.

For a complete understanding of the mop head itself and one exemplary embodiment of the roller retainers, FIG. 11 is a side plan view of the mop head of the rack and pinion roller mop.

Figure 12:
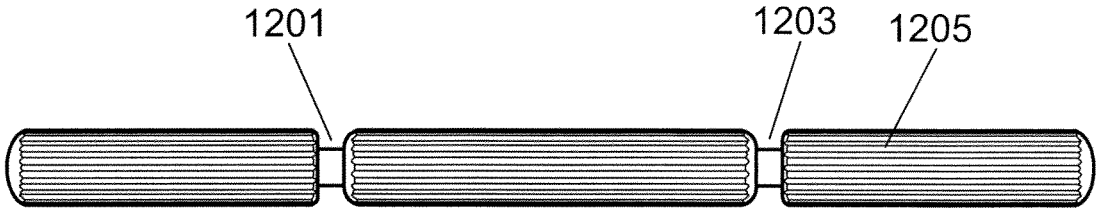
FIG. 12 is a plan view of a roller of the rack and pinion roller mop.
Figure 13:
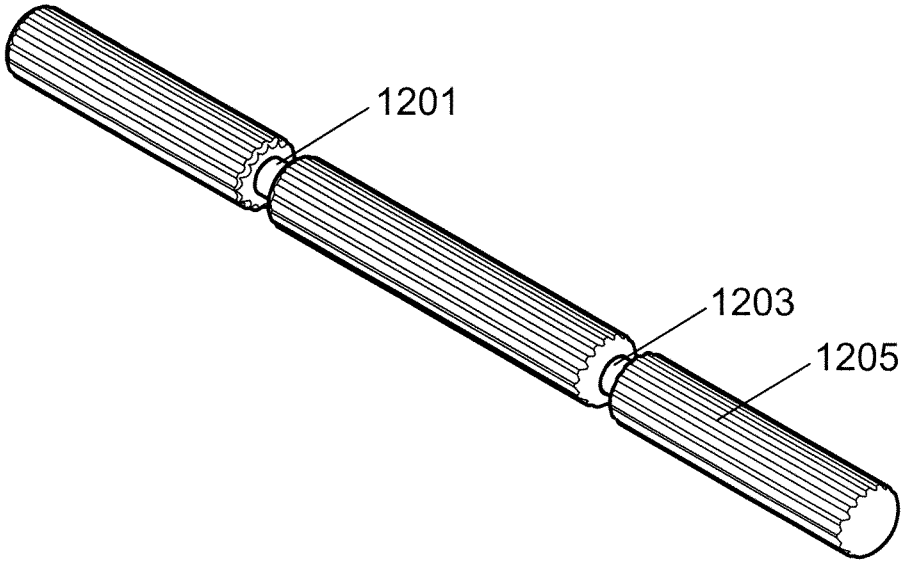
FIG. 13 is a perspective view of a roller of the rack and pinion roller mop.
Figure 14:
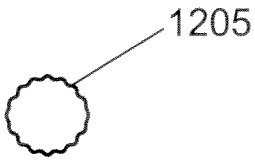
FIG. 14 is an end view of a roller of the rack and pinion roller mop.

FIGS. 12-14 depict an exemplary roller of the rack and pinion roller mop. FIG. 12 is a plan view of a roller of the rack and pinion roller mop showing a roller 1205 that may, in some embodiments of the present invention, represent the first roller 105 or the second roller 107 as seen in FIG. 1. In some embodiments of the present invention, the first roller 105 and the second roller 107 are the same. The roller is generally cylindrical and may have ridges such as longitudinal ridges, striations, bumps, cuts, texture, or other surface features to improve the traction of the sponge head as it travels between the rollers during operation of the rack and pinion roller mop. FIG. 13 is a perspective view of a roller of the rack and pinion roller mop showing a first retainer shaft 1201 and a second retainer shaft 1203. There may be more or less retainer shafts present in certain embodiments of the present invention. The retainer shafts, as previously described, engage with the roller retainer of the mop head to rotationally retain the rollers to the mop head. The retainer shafts may simply be a recessed groove in the roller that is molded or machined into the roller. This recessed groove may be generally rectangular in cross section, or it may be ovoid or partially ovoid. FIG. 14 is an end view of a roller 1205 of the rack and pinion roller mop showing exemplary longitudinal ridges.

Figure 16:
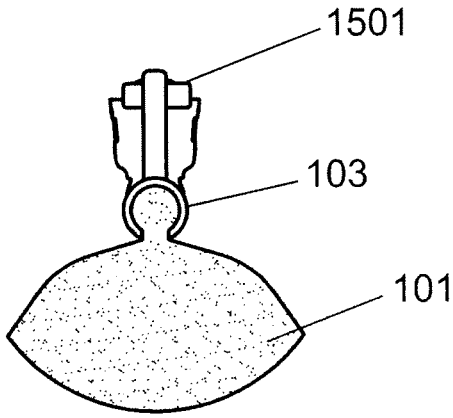
FIG. 16 is an end view of the sponge head, sponge head support and Italian thread coupler of the rack and pinion roller mop.

Turning lastly to FIGS. 15 and 16, the sponge head 101, as depicted in FIG. 1, is depicted detached from the rack and pinion roller mop. FIG. 15 is a perspective view of the sponge head, sponge head support and Italian thread coupler of the rack and pinion roller mop.

The sponge head 101 may be a synthetic sponge such as a polyurethane sponge, a cellulose sponge, a polyester sponge, a polyvinyl alcohol (PVA) sponge, a low density polyether sponge, or the like. In some embodiments of the present invention, additional materials such as a scouring pad may be attached to the sponge head 101 to facilitate cleaning. The sponge head 101 may also be a synthetic material that has sponge like properties but may not truly be considered a sponge. Such materials may include cloth or fabric structures, for example. Also shown in FIG. 15 is a sponge head support 103 that to may be of a length similar to the length of the sponge head 101, and may have an opening therein to receive the sponge head 101. In one embodiment of the present invention the sponge head support 103 may be of a tubular shape with a lengthwise opening to accommodate the sponge head 101. The tubular shape may be cylindrical, square, rectangular, or the like. Mechanical compression, an adhesive, mechanical fasteners, or the like, may be used to retain the sponge head 101 to the sponge head support 103. The sponge head support 103 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The sponge head support 103 may be made by injection molding, blow molding, machining, or the like. An Italian thread coupler 211 comprising a retention tab receiver 1503 is fixedly attached to the sponge head support 103. The retention tab receiver 1503 extends from an edge of the Italian thread coupler and may have an opening or a turned up edge to receive the retention tab 803 (see FIG. 8) of the rack cylinder. The retention tab receiver 1503 may also, in some embodiments of the present invention, have a support, gusset, spline, or similar mechanical structure to provide rigidity and structural integrity to the retention tab receiver 1503. The sponge head support 103 as well as the Italian thread coupler 211 and related retention tab receiver 1503 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The sponge head support 103 and the Italian thread coupler and related retention tab receiver may be made by injection molding, blow molding, machining, or the like. FIG. 16 is an end view of the sponge head, sponge head support and Italian thread coupler of the rack and pinion roller mop.

To use the rack and pinion roller mop, the sponge head 101 is typically soaked or placed in a liquid such as a cleaning solution or water. The sponge head 101 is then moved across the surface to be cleaned (such as a hard surface floor) to remove dirt. Once the user determines that the sponge head 101 is full of dirt, the sponge head 101 is placed in the liquid and the lever is moved such that the sponge head travels through the rollers and in the process is compressed and decompressed, causing the dirt to be expelled. The sponge head 101 is then removed from the liquid, and one or more final pulls on the lever will cause the excess liquid in the sponge head to be expelled, readying the rack and pinion roller mop for further cleaning. The novel details of construction of the double sided spray mop being heretofore provided and depicted.

It is, therefore, apparent that there has been provided, in accordance with the various objects of the present invention, a rack and pinion roller mop. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A rack and pinion roller mop comprising:

a mop head comprising a sponge receiver opening and a pole receiver;

a first roller and a second roller rotationally engaged with the mop head;

a sponge head support coupled to a sponge head where the sponge head support is generally located between the first roller and the second roller;

a thread coupler comprising a retention tab receiver fixedly attached to the sponge head support;

a rack cylinder having a plurality of teeth along an outer surface of the rack cylinder;

a retention tab mechanically coupled to the rack cylinder for mating with the retention tab receiver of the thread coupler;

a pole having a thread end and placed through the rack cylinder and mated with the thread coupler;

a pinion lever having a pin receiver and a pinion gear arrangement where in operation the pinion gear engages with the rack cylinder so that when the pinion lever is moved there is linear movement of the rack cylinder, sponge head support and sponge head thereby compressing the sponge head between the first roller and the second roller.

2. The rack and pinion roller mop of claim 1, further comprising a first pinion lever receiver and a second pinion lever receiver.

3. The rack and pinion roller mop of claim 2, further comprising a first pin placed through the first pinion lever receiver and a second pin placed through the second pinion lever receiver, the first pin being coupled to the second pin through the pin receiver of the pinion lever to moveably retain the pinion lever to the mop head.

4. The rack and pinion roller mop of claim 2, further comprising a support fixed to the first pinion lever receiver and the second pinion lever receiver.

5. The rack and pinion roller mop of claim 1, further comprising threads internal to the rack cylinder for retaining the pole.

6. The rack and pinion roller mop of claim 1, further comprising an annular end having a rotational joint mechanically coupled to the pole.

7. The rack and pinion roller mop of claim 6, further comprising a coupler for providing mechanical coupling of the annular end to the pole.

8. The rack and pinion roller mop of claim 7, further comprising a coupler overlay.

9. The rack and pinion roller mop of claim 1, further comprising a first roller retainer, a second roller retainer, a third roller retainer, and a fourth roller retainer mechanically fixed to the mop head.

10. The rack and pinion roller mop of claim 9, wherein the first roller has a first retainer shaft and a second retainer shaft, the first retainer shaft of the first roller being retained by the first roller retainer and the second retainer shaft of the first roller being retained by the second roller retainer; and the second roller has a first retainer shaft and a second retainer shaft, the first retainer shaft of the second roller being retained by the third roller retainer and the second retainer shaft of the second roller being retained by the fourth roller retainer.

11. The rack and pinion roller mop of claim 10, wherein the first roller comprises longitudinal ridges.

12. The rack and pinion roller mop of claim 10, wherein the second roller comprises longitudinal ridges.

13. A rack and pinion roller mop head comprising:

a mop head comprising a sponge receiver opening and a pole receiver;

a first roller and a second roller rotationally engaged with the mop head;

a sponge head support coupled to a sponge head where the sponge head support is generally located between the first roller and the second roller;

a thread coupler comprising a retention tab receiver fixedly attached to the sponge head support;

a rack cylinder having a plurality of teeth along an outer surface of the rack cylinder;

a retention tab mechanically coupled to the rack cylinder for mating with the retention tab receiver of the thread coupler;

a pinion lever having a pin receiver and a pinion gear arrangement where in operation the pinion gear engages with the rack cylinder so that when the pinion lever is moved there is linear movement of the rack cylinder, sponge head support and sponge head thereby compressing the sponge head between the first roller and the second roller.

14. The rack and pinion roller mop head of claim 13, further comprising a first pinion receiver and a second pinion receiver.

15. The rack and pinion roller mop head of claim 14, further comprising a first pin placed through the first pinion receiver and a second pin placed through the second pinion receiver, the first pin being coupled to the second pin through the pin receiver of the pinion lever to moveably retain the pinion lever to the mop head.

16. The rack and pinion roller mop head of claim 14, further comprising a support fixed to the first pinion receiver and the second pinion receiver.

17. The rack and pinion roller mop head of claim 13, further comprising threads internal to the rack cylinder.

18. The rack and pinion roller mop head of claim 13, further comprising a first roller retainer, a second roller retainer, a third roller retainer, and a fourth roller retainer mechanically fixed to the mop head.

19. The rack and pinion roller mop head of claim 18, wherein the first roller has a first retainer shaft and a second retainer shaft, the first retainer shaft of the first roller being retained by the first roller retainer and the second retainer shaft of the first roller being retained by the second roller retainer; and the second roller has a first retainer shaft and a second retainer shaft, the first retainer shaft of the second roller being retained by the third roller retainer and the second retainer shaft of the second roller being retained by the fourth roller retainer.

20. The rack and pinion roller mop head of claim 19, wherein the first roller comprises longitudinal ridges.

21. The rack and pinion roller mop head of claim 19, wherein the second roller comprises longitudinal ridges.

* * * * *